United States Patent [19]

Phillips

[11] 4,067,377

[45] Jan. 10, 1978

[54] AIR CONTROL DAMPER

[75] Inventor: Leonard R. Phillips, St. Petersburg, Fla.

[73] Assignee: Anemostat Products Division, Dynamics Corporation of America, Scranton, Pa.

[21] Appl. No.: 696,311

[22] Filed: June 15, 1976

Related U.S. Application Data

[63] Continuation-in-part of Ser. No. 524,141, Nov. 15, 1974, abandoned.

[51] Int. Cl.[2] ..... A47H 1/00; E06B 3/32

[52] U.S. Cl. ..... 160/98

[58] Field of Search ..... 160/1-9, 160/98, 25, 121, 107, 101, 122, 241; 49/4, 7, 8; 251/212

[56] References Cited

U.S. PATENT DOCUMENTS

| | | | |
|---|---|---|---|
| 917,983 | 4/1909 | Wilson | 160/8 |
| 1,866,882 | 7/1932 | Dixson | 160/98 |
| 3,085,247 | 4/1963 | Bixby | 160/122 |
| 3,273,632 | 9/1966 | McCabe | 160/1 |
| 3,306,344 | 2/1967 | Youngs | 160/241 |
| 3,342,243 | 9/1967 | Salter | 160/107 |
| 3,389,737 | 6/1968 | Arnold et al. | 160/107 |
| 3,397,009 | 8/1968 | Landenberger | 160/241 |
| 3,495,606 | 2/1970 | Phillips | 251/212 |
| 3,747,662 | 7/1973 | Kurz | 160/1 |

FOREIGN PATENT DOCUMENTS

| | | | |
|---|---|---|---|
| 375,208 | 6/1932 | United Kingdom | 160/3 |

*Primary Examiner*—Paul R. Gilliam
*Assistant Examiner*—Victor N. Sakran
*Attorney, Agent, or Firm*—McCormick, Paulding & Huber

[57] ABSTRACT

This invention relates to a fire and smoke damper assembly capable of being positioned in interruptive disposition relative to the flow of air through a conduit wherein the assembly includes a flexible curtain movably mounted on the frame and attached in driven relation to a curtain mounting rod rotatably mounted on the frame. The rod and curtain are driven manually by biasing means or by exteriorly mounted motor means. Curtain guide elements including a pair of screens are arranged in spaced, substantially parallel relation to one another across the face of the conduit so as to define a channel in which the curtain is movable relative to the screens into and out of engagement about the curtain periphery with the frame. In another embodiment the curtain is mounted on a rod and pulled therefrom by a negator spring to close the conduit, and in still another embodiment, the curtain is maintained in an extended or flattened condition in its open position and is pulled therefrom by a negator spring to its closed position.

9 Claims, 12 Drawing Figures

FIG. 2
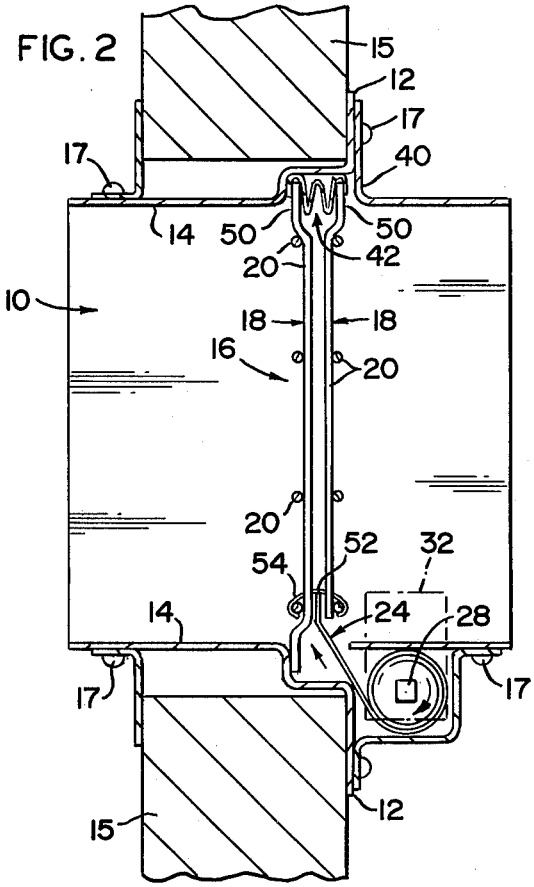
FIG. 4
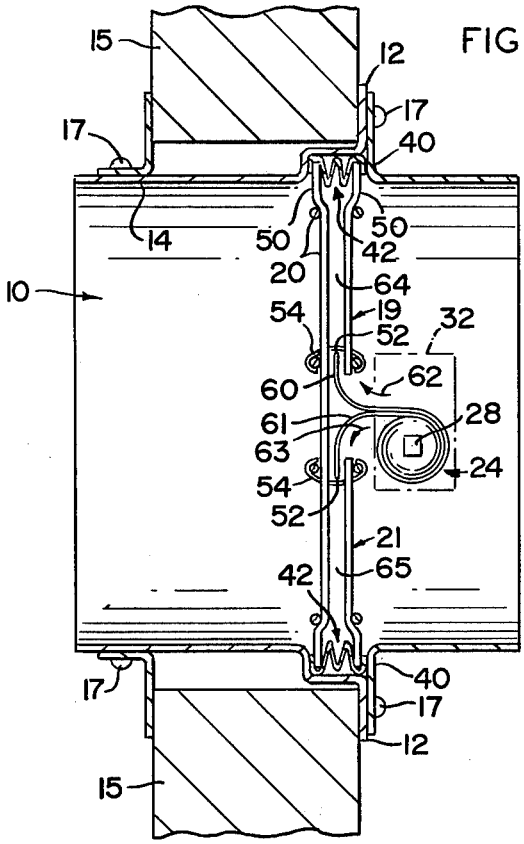
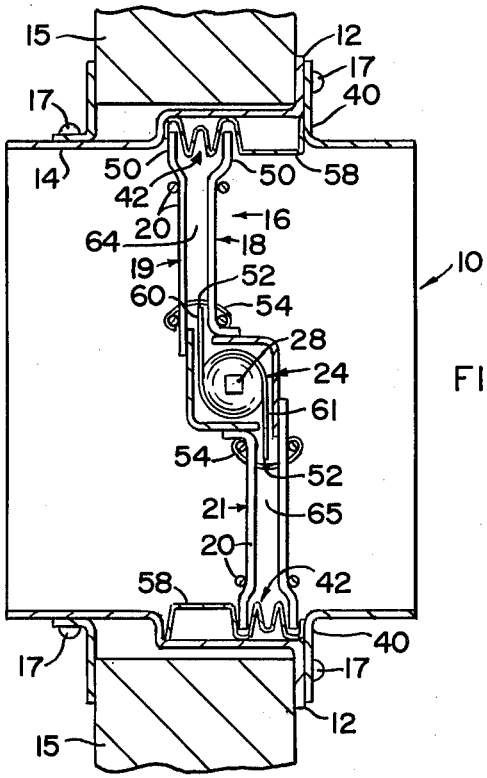
FIG. 5
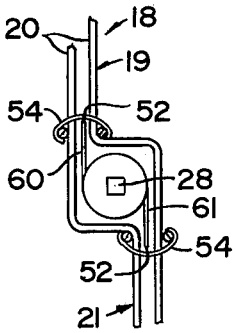
FIG. 6
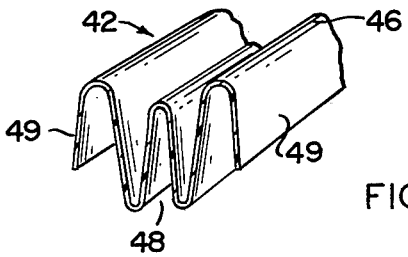
FIG. 7

AIR CONTROL DAMPER

CROSS-REFERENCE TO RELATED APPLICATIONS

This application is a continuation-in-part Application of copending application "AIR CONTROL DAMPER" by the same inventor filed on Nov. 15, 1974, Ser. No. 524,141, now abandoned.

BACKGROUND OF THE INVENTION

This invention relates to a fire and smoke damper assembly mounted in the interior of an air passage conduit and positionable between an open and closed disposition relative to the path of flow through the conduit wherein smoke and/or air may be prohibited or severely restricted from flowing through the conduit beyond the damper assembly.

DESCRIPTION OF THE PRIOR ART.

Numerous devices are commercially available in the prior art to control the flow of fire and smoke ladened air during the burning of various types of building structures. For many years it has been recognized that proper control of ventilation can restrict and limit damage due to smoke and fire to a localized area of a building structure. Of the prior art devices noted above, a great many are specifically directed to the control of the fire or smoke by means of structural designs concerned with damper assemblies.

Damper assemblies of the prior art are found in numerous and varied applications including various fluid flow restriction devices to block fluid from passing through apertures including windows, doors or other normal passages intended for the flow of air. Generally, such damper structures comprise a curtain structure dimensioned and configured to be positioned across the given air passage way. To accomplish sufficient sealing of the curtain relative to the passage means, various structures have been incorporated in the known prior art devices.

For example, the U.S. Pat. No. 1,369,518, to Bumbarger, discloses a fire door structure having a flexible metal sheet mounted substantially entirely within a frame structure and designed to be positioned across a fluid passage for the purpose of prohibiting fluid flow therethrough. Similarly, the U.S. Pat. No. 3,613,765 to Sivin, is related to a fire door assembly made from a flexible material capable of being positioned into and out of flow interruptive position relative to a passage. As in conventional prior art devices, positioning of the fire door or damper across the fluid passage prohibits further flow of smoke, fire, etc. through the passage.

U.S. Pat. Nos. 3,575,229 to Alley; and 3,734,114 Phillips; further disclose fire damper structures of varying construction capable of being movable into and out of smoke, air or fire blocking relation to a given passage through which air or like fluid is intended to flow.

While the above-noted prior art structures are possibly operable for certain intended applications, the majority of the prior art devices noted are generally considered to be unnecessarily complex from a structural standpoint. In addition, it is highly desirable that maintenance, initial manufacture and particularly installation of such a fire damper assembly be accomplished with the minimum expenditure of both time and expense. It is also extremely important that an efficient fire damper assembly be capable of adaptation to presently existing housing structures or buildings such that installation can be accomplished in existing ventilation systems.

SUMMARY OF THE INVENTION

This invention relates to a fire and smoke damper assembly comprising a frame specifically dimensioned and configured to fit within an air passage or, more particularly, a conduit designed for the passage of air or like fluid therethrough. As in most fire and smoke damper assemblies, the location of the assembly is predetermined to control the spreading of smoke laden air or fire through a ventilation system. This, in turn, has the effect of prohibiting a fire from spreading throughout a given building structure and hopefully allowing the damage to be contained in a fairly localized area.

The damper assembly of the present invention further comprises a curtain means of a fire resistant flexible sheet of metallic or like material movably mounted relative to the frame. A curtain support means including a rotatable mounting shaft is connected to the frame in certain embodiments of the invention and is attached in driving relation to the curtain itself. Driving action of the shaft may be provided by a motor means or a biasing means in the form of a spring element connected to the mounting shaft and the curtain means thereon. More particularly, the curtain is movable between a closed and an open position relative to the fluid passage conduit.

This function is provided by disposition of the curtain transversely or across the "face" of the conduit so as to essentially seal off the opening which is formed in the frame and dimensioned to substantially correspond to the opening or passage in the fluid passage conduit. The open position of the curtain is essentially defined by the curtain itself being rolled up almost entirely on the rod or drive shaft comprising the curtain support means. Alternatively the closed position is defined by the curtain means extending from the mounting shaft of the curtain support means to a portion of the periphery of the frame where the edge of the curtain sealingly engages this predisposed peripheral portion of the frame. This sealing engagement eliminates smoke laden air or the like passing beyond the curtain as explained above.

Guide or support means in the form of one or more screen elements or the like is connected to the frame across the face or opening formed in the frame. Ideally, a pair of screen elements are formed in substantially parallel, spaced relation to one another so as to define a channel therebetween. The curtain means is configured, dimensioned and so disposed to pass in the channel from the mounting shaft to the peripheral portion of the frame where sealing engagement takes place. In one embodiment of the present invention the screen elements of the guide means each comprise intermeshing, spaced apart guide wires arranged relative to one another so as to be sufficiently porous relative to the fluid passing through the fluid passage conduit. The design of the subject fire damper assembly is such as to allow free passage of normal air through the fluid passage conduit when an emergency situation such as a fire or the like is not present.

In its open position, the curtain is attachable to the guide screen elements or frame by means of fusible links orienting the leading edge of the curtain means to the screen element in a "ready" position. Upon forceful activation of the rotatable mounting shaft for the curtain means, and removal of the fusible links the curtain is directed to the peripheral portion of the frame, oppositely disposed relative to the curtain means and in communicating relation with the channel defined by the screen elements. It should be noted that the mounting shaft can be forecefully rotated either manually or from a motor means and may be automatically activated by fire, smoke or any other type of conventional or prior art sensor element capable of detecting an abnormal condition relative to the air passing through the conduit. The motor means referred to may take the form of the biasing means referred to above. It is specifically anticipated that a temperature sensitive or actuated control means be used in combination with the motor means for activating the mounting shaft. Otherwise the mounting shaft of the curtain support means may be manually activated.

The mountig shaft can also be spring loaded by the properly disposed spring element, comprising the biasing means, such that movement of the shaft is accomplished automatically upon release of the spring element. This, in turn, occurs upon release or breaking of the fusible links from their holding position. Upon such release, the spring element is released and the force of the spring causes automatic positioning of the damper structure in a closed disposition. When a spring means is so utilized, the motor means referred to above may also be operatively attached. One embodiment of the invention contemplates the spring means as a normal operating means on rupture of a fusible link and the motor means as a test device. Another embodiment contemplates the use of the spring means as a safety device whereby failure of the driving motor means causes the spring to actuate and thereby drive the mounting shaft to close the damper structure.

It should be further noted that the fusible link itself may comprise a metallic or like structure capable of melting or otherwise "deteriorating" at a predetermined temperature. Such temperature could be in the range of 165° F and cause release of the link when the surrounding environment reaches that temperature.

Another embodiment of the present invention comprises the curtain means including at least two curtain elements, both of which are mounted on the mounting shaft in overlaying relation to one another. In this embodiment the mounting shaft is disposed in spaced relation to the oppositely disposed peripheral portions of the frame or approximately mid-way across the face of the frame. Upon rotation of the mounting shaft the separate curtain elements are driven outwardly from the shaft in opposite directions in individually formed channels communicating with oppositely disposed peripheral portions of the frame.

Yet another embodiment of the present invention comprises the frame and curtain means having a substantially curvilinear or circular configuration so as to render it adaptable to any similarly shaped conduit in which it may be mounted.

Yet another embodiment of the present invention contemplates the biasing means in the form of an external spring element attached in the vicinity of or adjacent to a free edge or end portion of the curtain means and connected to the conduit, frame or other structural member so as to exert a pulling biasing force on the curtain means. In this embodiment, the curtain may be mounted on a rod or, alternatively, the mounting rod may be eliminated and in its non-sealing or "open" position relative to the fluid conduit, the curtain means may lie flat or in a non-rolled and extended or folded position.

The invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

FIG. 2 is a side cross-sectional view taken along line 2—2 of FIG. 1 showing the interior of the fluid passage conduit and details of the screen elements comprising the guide means.

FIG. 4 is a side cross-sectional view taken along line 4—4 of FIG. 3 showing the interior of the conduit and details of the screen elements.

FIG. 5 is a side cross-sectional view showing details of yet another embodiment of the present invention.

FIG. 6 is a detailed view of a means of attaching the leading edge of the curtain means to the screen elements comprising the guide means.

FIG. 7 is a detailed view of the sealing means of the present invention.

DETAILED DESCRIPTION

Figure 1:
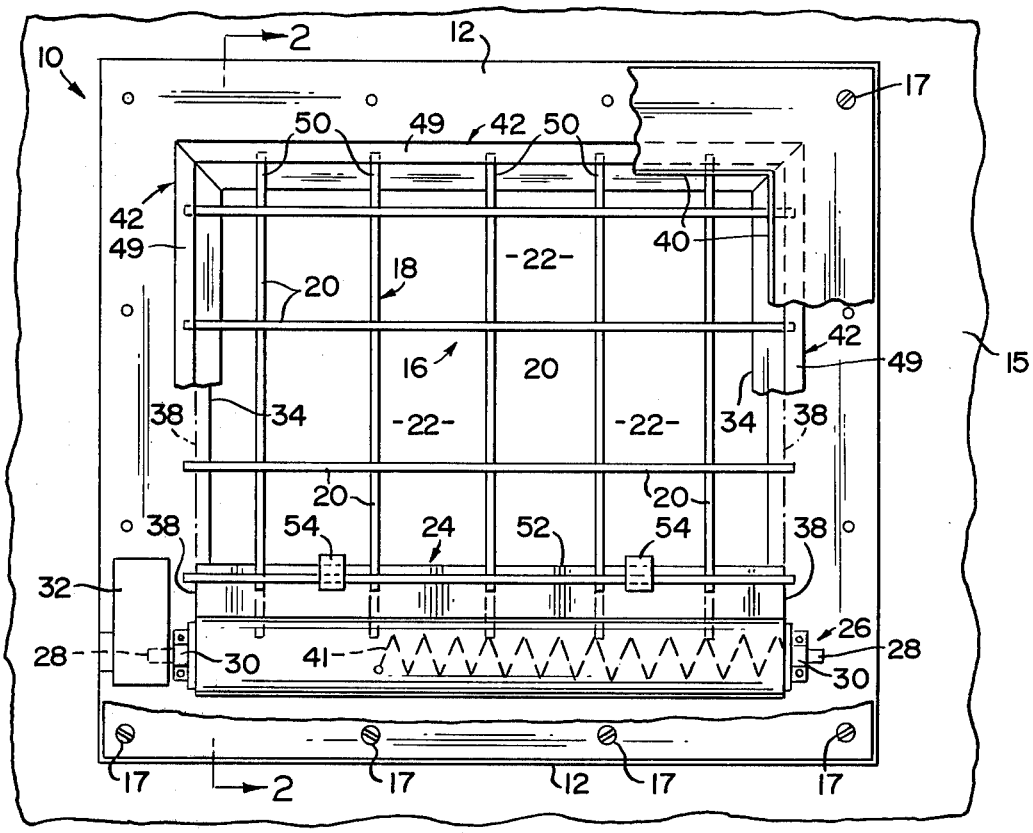
FIG. 1 is a front plan view of one embodiment of the present invention showing the fire damper assembly in open position relative to a fluid passage conduit.

FIG. 1 discloses one embodiment of the present invention wherein the fire damper assembly is generally indicated as 10. The assembly comprises a frame 12 which may be integrally formed as part of a fluid passage conduit means 14 or otherwise separately attached to the conduit 14 in supporting relation to curtain guide and support means generally indicated at 16, (FIG. 2). The guide and support means comprises one or more guide wires 20 which may be unidirectional or in crossing and engaging relationship with one another. In any event, the disposition of the guide wires 20 is such as to allow sufficient space 22 therebetween to allow adequate fluid flow or passage of air or the like through conduit 14. As shown in FIGS. 2, 4 and 5, the fire damper assembly 10, irrespective of the particular structural details of the embodiment disclosed, is primarily designed to be mounted within a fluid passage conduit 14 in any type of conventional structure adjacent to or between wall elements 15 as shown. Conventional type connector elements 17 may be utilized for attachment between fluid passage conduit 14, wall elements 15, and frame means 12 so as to interconnect these elements to one another. As shown, these conventional connector elements may take the form of screw threaded fasteners, nail type elements, staples or the like. The particular embodiment of the connector utilized does not form per se, any part of the present invention.

The damper further comprises a curtain means 24 made from a thin flexible metallic or other material adapted for mounting on curtain supporting means 26. Curtain supporting means 26 comprises a rotatable mounting shaft 28 mounted for rotation about its own axis by virtue of its connection at opposite ends to bearing assemblies 30 and having one end disposed in driven relation to an external motor means 32. Alternately, the mounting shaft 28 may be manually rotated from an external location.

Figure 11:
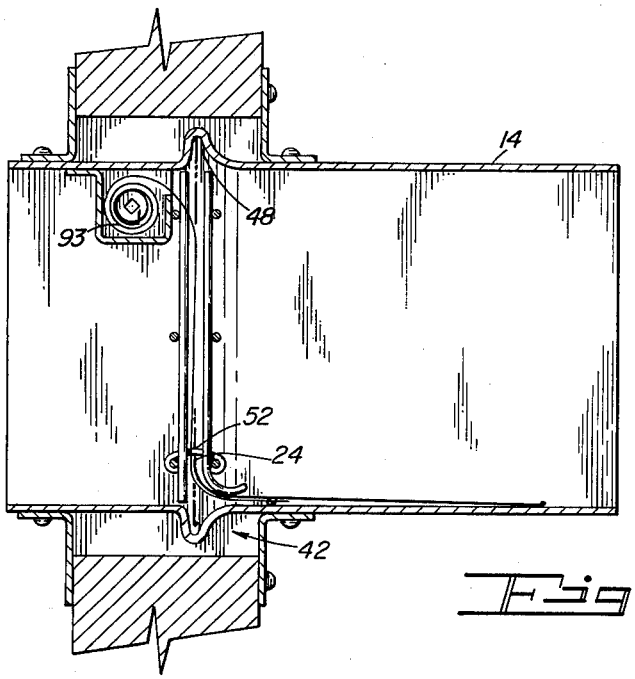
Figure 12:
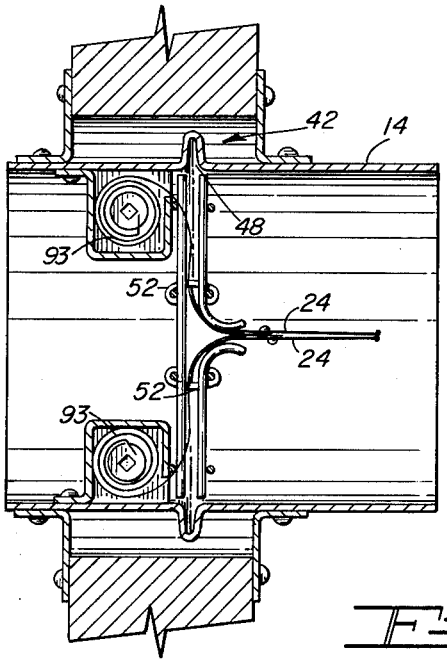

As shown in FIGS. 1 and 2, one embodiment of the present invention includes the curtain supporting means 26 disposed adjacent to one peripheral edge (bottom as shown in FIGS. 1 and 2) of the frame 12. More particularly, the mounting shaft 28 is disposed adjacdnt or contiguous to the opening 34 defined by the face of the frame through which air passes. The curtain means 24 is dimensioned and configured to close the entire opening 34 so as to present a substantially fluid tight seal of the fluid passage conduit 14. This is at least partially accomplished by the side edges 38 of curtain means 24 passing in slots or grooves of frame 12 behind outwardly extending lips 40. Similarly, this sealing arrangement is further established by a sealing means 42 (FIGS. 2, 4, 5 and 7) in the form of a flexible strip 46. This strip has a curtain receiving and sealing crevice or the like 48 formed therein and arms 49 are dimensioned and disposed to receive upper portions 50 of screen elements 18. As shown in FIGS. 11 and 12, the sealing means 42 may also be integrally formed in the wall of the fluid conduit 14.

A fusible link 54 may be attached to the leading edge 52 for the purpose of connecting the edge and the curtain 24 itself to the screen elements 18. Upon rupture and dislodging of the fusible links from the spaced apart screen elements, the leading edge 52 is brought into sealing engagement with the sealing means 50 by being disposed on the interior of crevice 48 and in frictional engagement with the interior surfaces thereof.

In FIG. 5 outwardly extending flanges 58 are connected or integrally attached to the remainder of sealing means 42 and are disposed thereon so as to interconnect the sealing means 42 to the the frame adjacent to the screen elements comprising the guide means. These flanges may be flexible so as to allow simplified installation while accomplishing efficient placement of the sealing means 42 for sealing purposes.

Turning to FIGS. 4 and 5, another embodiment of the present invention comprises the mounting shaft 28 disposed in spaced relation to oppositely disposed longitudinal or peripheral edges of the frame means. In this embodiment two curtains 60 and 61 are utilized. The curtain means are rotatably mounted on shaft 28 in overlaying relation to one another. Upon activation or rotation of the mounting shaft 28, the curtains 60 and 61 travel along opposite portions 19 and 21 respectively of the guide means as indicated by directional arrows 62 and 63 respectively. In the embodiment shown in FIG. 4, both curtain means 60 and 61 exit from shaft 28 in the same direction and then travel in the opposite directions upon entry of the individual curtain means into channels 64 and 65 defined by oppositely disposed portions of the screen means 19 and 21 respectively. In the embodiment shown in FIG. 5, curtain means 60 and 61 exit from shaft 28 in opposite directions as they enter channels 64 and 65. Again, fusible links 54 are provided in interconnecting relation in both FIGS. 4 and 5 between leading edges 52 on the respective curtain means and the screen elements 18.

Figure 3:
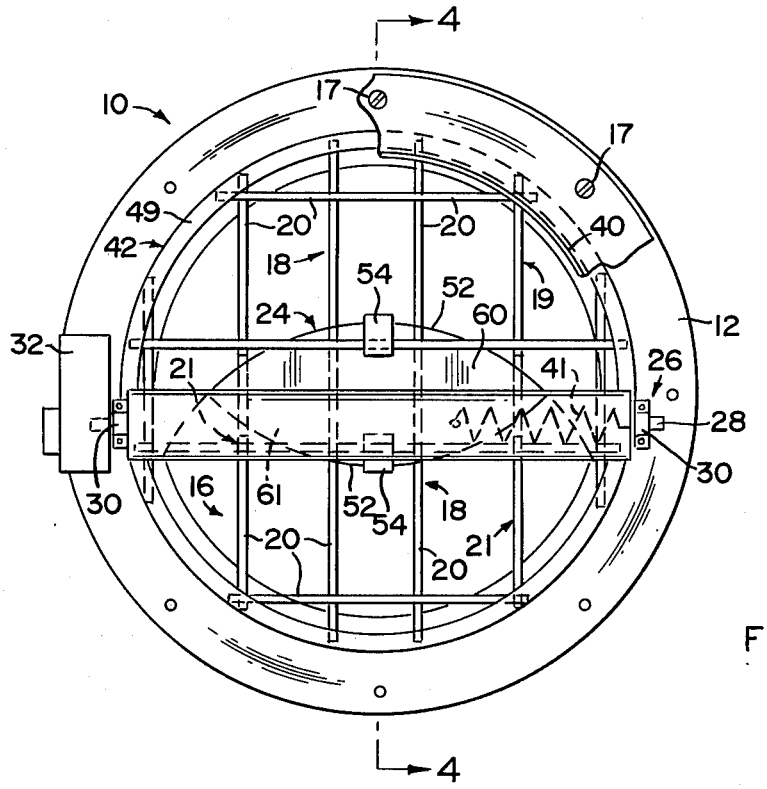
FIG. 3 is a front plan view of another embodiment of the present invention having a cylindrical frame, and circular guide means and curtain means.

In the embodiment shown in FIG. 3, the fire damper assembly 10 has a circular or curvilinear configuration so as to readily be adapted to a correspondingly configured conduit passage means as indicated. This embodiment is basically intended to show that the fire damper assembly of the present invention can be designed into any applicable configuration corresponding to a specific passage to be regulated.

A further structural feature of the present invention includes the mounting shaft 28 being spring biased by means of spring elements 41 connected to the shaft and positioned to drive the curtain element or elements to closed position on rupture of associated fusible links.

Figure 8:
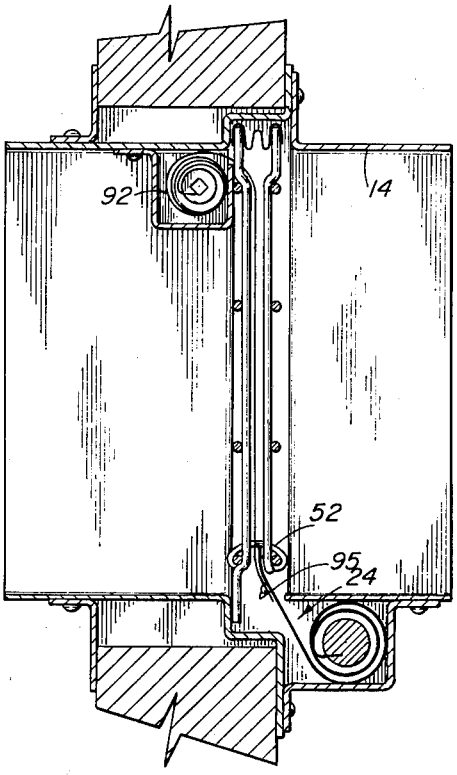
FIGS. 8–12 show still further embodiments of the invention in side cross sectional views.

As shown in FIG. 8, another embodiment of the present invention includes the curtain supporting means comprising at least in part, biasing means including a negator spring element 92 interconnected between the curtain means 24 and fluid conduit 14 or other structural base. Spring element 92 extends downwardly within the guide means 16 and is connected to the curtain means by a rivet 95 and disposed to "drive" or pull the curtain means 24 into or toward its closed or sealing position. As shown in the open position the curtain means 24 is wound on a rod 28. Activation of the curtain means into and out of its closed position may occur manually or automatically as explained with reference to previous embodiments, and it will also be apparent that automatic spring biased closing operation will occur on rupture of fusible link 52.

Figure 9:
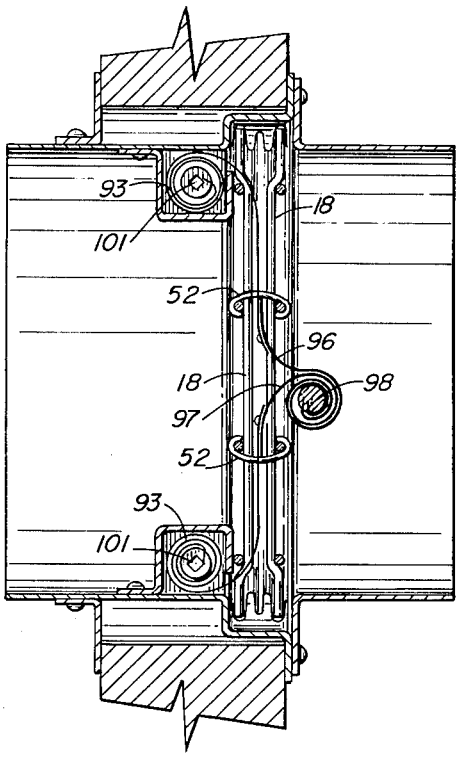

FIG. 9 shows another embodiment similar to FIG. 4 wherein curtains 96 and 97 are disposed in the approximate center of fluid conduit 14 on rod 98. The curtains 96 and 97 are fed into guide means 16 between screen elements 18 in opposite directions as shown. Accordingly, a curtain supporting means comprises biasing means including two negator spring elements 93. The two spring elements 93 are disposed in biasing relation to the curtain means 96 and 97 to automatically close the latter on rupture of fusible links 52. Further, manual or motor means may be employed to drive either the curtain rod 98 or spring mounting rods 101 whereby to move the curtain means in either opening or closing directions.

Figure 10:
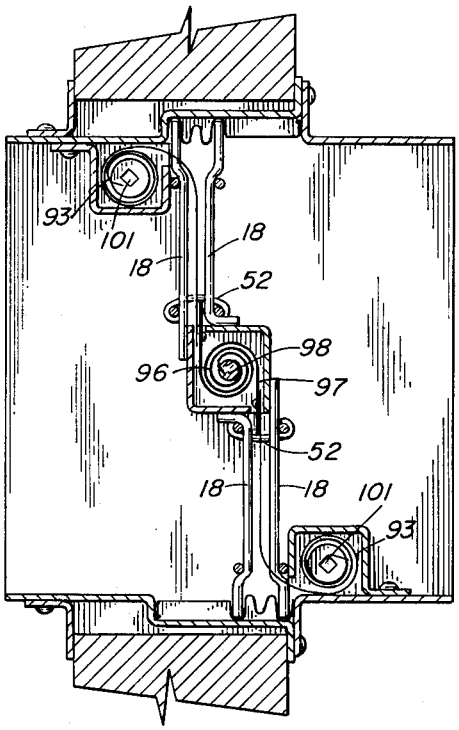

FIG. 10 shows an embodiment similar to FIG. 5 but with "pull out" biasing means in the form of negator springs 93.

As mentioned above, FIG. 11 shows sealing means integrally formed in the wall of a conduit 14. It should also be observed that a curtain means such as 24 in FIG. 11 need not be supported on a rod or shaft and may instead be extended or maintained in a flat condition when open. On rupture of fusible link 52, the curtain means is pulled to the closed position be negator spring 93.

The flattened or extended arrangement of the curtain means may also be employed with double curtan means as in FIG. 12. Curtain means 24 are respectively pulled in opposite directions to closed position by negator springs 93.

In all embodiments the guide means associated with the thin flexible curtain means serve also to support the latter in the closed position. That is, the guide means serve as rigid back-up elements as when a stream of water from a fire hose impinges on the thin flexible curtain means. Light-weight curtain means may thus be employed and yet the desired structural integrity and resistance to hose water is achieved. Obviously, hose water resistance of the curtain means and guide means may also be unidirectional as when a single screen element is provided.

It will thus be seen that the objects made apparent from the preceding description are efficiently attained and, since certain changes may be made in the above article without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention which, as a matter of language, might be said to fall therebetween.

Now that the invention has been described, I claim:

1. A fire damper assembly of the type primarily designed for mounting in a conduit in an air distribution system, said damper assembly comprising frame means adapted to be connected in the conduit and defining an air passageway communicating with the conduit for conduit air flow therethrough, marginal sealing means in said frame means about said air passageway, a damper in said frame means comprising at least one thin flexible sheet of fire resistant material having passageway opening and closing positions, the sheet of material extending transversely across said passageway in its passageway closing position, means for moving said sheet of material between its said passageway opening and closing positions, and support means for said sheet of material extending transversely across said air passageway adjacent and on a downstream side of said sheet of material in the passageway closing position of the latter, said support means being open to conduit air flow therethrough but of substantially rigid construction so as to lend structural integrity to the sheet material when the latter is forced thereagainst by conduit air pressure, and said sheet of material in its passageway closing position also engaging said marginal sealing means whereby to provide a positive fire stop.

2. A fire damper assembly as set forth in claim 1 wherein a second thin flexible sheet of fire resistant material is provided for cooperative closing of said passageway with said first sheet of material.

3. A fire damper assembly as set forth in claim 1 wherein a second support means is provided on an opposite side of said sheet material.

4. A fire damper assembly as set forth in claim 1 wherein said sheet material and sealing means are so arranged as to be maintained in engagement by conduit air pressure.

5. A fire damper assembly as set forth in claim 1 wherein said sheet material is maintained in a coiled condition in its passageway opening position and uncoiled to a substantially flat and extended condition in its passageway closing position.

6. A fire damper assembly as set forth in claim 1 wherein said means for moving said sheet material is operable in response to an incident of combustion.

7. A fire damper assembly as set forth in claim 1 wherein said means for moving said sheet material includes biasing means tending to move said sheet material to its passageway closing position.

8. A damper assembly as set forth in claim 7 and including a restraining means acting in opposition to said biasing means to maintain said sheet material in an open position.

9. A damper assembly as set forth in claim 8 wherein said restraining means takes the form of a fusible link.

* * * * *

UNITED STATES PATENT OFFICE

CERTIFICATE OF CORRECTION

Patent No. 4,067,377 Dated January 10, 1978

Inventor(s) Leonard R. Phillips

It is certified that error appears in the above-identified patent and that said Letters Patent are hereby corrected as shown below:

"Assignee: Anemostat Products Division,
Dynamics Corporation of America,
Scranton, Pa."

SHOULD BE DELETED ON COVER PAGE.

Signed and Sealed this

Sixth Day of June 1978

[SEAL]

*Attest:*

RUTH C. MASON
*Attesting Officer*

DONALD W. BANNER
*Commissioner of Patents and Trademarks*